United States Patent [19]

McKay et al.

[11] Patent Number: 4,557,626

[45] Date of Patent: Dec. 10, 1985

[54] ROAD PATCHING VEHICLE

[75] Inventors: Jack E. McKay; Robert E. Brown, both of Hayden Lake, Id.

[73] Assignee: Road Renovators, Inc., Hayden Lake, Id.

[21] Appl. No.: 607,923

[22] Filed: May 7, 1984

Related U.S. Application Data

[63] Continuation-in-part of Ser. No. 422,750, Sep. 24, 1982, abandoned.

[51] Int. Cl.[4] ..... E01C 23/09

[52] U.S. Cl. ..... 404/90; 404/95; 404/102; 404/108; 404/112; 404/122; 299/39

[58] Field of Search ..... 404/75, 77, 79, 90, 404/91, 95, 102, 104, 108–110, 112, 113, 118, 122; 299/39, 41

[56] References Cited

U.S. PATENT DOCUMENTS

| | | | |
|---|---|---|---|
| 1,613,051 | 1/1927 | Napier . | |
| 1,714,659 | 5/1929 | Chausse . | |
| 2,394,017 | 2/1946 | Seaman | 404/95 |
| 2,732,197 | 1/1956 | Cornett . | |
| 2,747,475 | 5/1956 | West | 404/91 |
| 3,020,812 | 2/1962 | Gross . | |
| 3,055,280 | 9/1962 | Neville | 404/95 |
| 3,217,620 | 11/1965 | Mindrum et al. . | |
| 3,564,985 | 2/1971 | Heller | 404/95 |
| 3,598,446 | 8/1971 | Hatcher | 299/39 |
| 3,625,120 | 12/1971 | Nagy . | |
| 3,771,893 | 11/1973 | Miller | 404/101 |
| 3,779,607 | 12/1973 | Staab | 299/39 |
| 3,874,366 | 4/1975 | Cutler | 404/95 X |
| 4,018,540 | 4/1977 | Jackson, Sr. | 404/95 |
| 4,124,325 | 11/1978 | Cutler | 404/90 X |
| 4,172,679 | 10/1979 | Wirtgen | 404/90 |
| 4,215,949 | 8/1980 | Garbriel, Jr. | 404/110 |
| 4,272,212 | 6/1981 | Bauer, Jr. et al. | 404/91 X |

*Primary Examiner*—James A. Leppink
*Assistant Examiner*—Beverly E. Hjorth
*Attorney, Agent, or Firm*—Wells, St. John & Roberts

[57] ABSTRACT

A roadway surface patching vehicle is described wherein virtually all roadway patching procedures may be performed by a single operator within a control station of the vehicle unit. The vehicle includes a number roadway repair tools mounted to a moveable carriage on the vehicle frame. This carriage is situated intermediate the control station and the front vehicle wheels. Among the operative tools are a cutter head and a vacuum head adjacent to the cutter head for receiving and directing loose particulate roadway surface material to a storage hopper for subsequent reblending and reuse. The vacuum head may also be used to clean the area adjacent the repair following placement and finished tamping and rolling of the new repair materials. A tamping head is also mounted to the carriage for movement therewith and a roller is mounted to the frame for finishing the repair to grade. A spread flame torch is provided on the carriage to heat the prepared cavity, melt ice, or dry the area in the vicinity of the cavity to facilitate reception of the roadway repair material therein. A tack coat spray nozzle is also situated to spray the cavity walls prior to reception of the repair material. All tools may be mounted to a turret on the carriage to be selectively rotated into view prior to operation. All operations involved in preparing the cavity and effecting the repair may thus be performed within full view of the operator station and by a single operator.

25 Claims, 11 Drawing Figures

32
109
73
33
104
84
74
72
106
112
75
112
68
67
71
36
108
35
31
39
30
29

82

89
87
90
91
92
91
83

82
83
97
95
101
100
94
102
99
105
98
84
104

ROAD PATCHING VEHICLE

REFERENCE TO RELATED APPLICATIONS

This application is a Continuation-in-Part of a prior U.S. application, Ser. No. 422,750 filed Sept. 24, 1982, now abandoned.

FIELD OF THE INVENTION

The present invention relates to repair of damaged roadway surfaces.

BACKGROUND OF THE INVENTION

Required prerequisites of a solid and lasting roadway repair are a clean vertical wall cavity routed to solid roadway material with a compacted base for shrinkage free adhesion and compaction of the new aggregate.

Numerous inventions have been proposed for speeding and reducing the cost of roadway repair. Much of the machinery was designed with a specific objective of reducing the number of personnel required for roadway repair. Almost all of these machines, however, require the vehicle to be in motion during repair activity. This deprives the operator of a direct view of the roadway area to be repaired. Further, since attention is diverted by concurrent vehicle movement, the operator cannot devote all efforts to repair work and ignore the vehicle driving operations. It is thus impossible for the operator to make required repairs with a high degree of care and accuracy. It is further impossible to localize repair work to a selected area.

It is desirable to provide a completely cleaned repair area to eliminate subsequent area cleanup of materials which, with prior devices, have been swept or air blasted to the roadway side or shoulder. Air blasting and/or sweeping the routed roadway material creates heavy dusting and air pollution.

U.S. Pat. No. 3,217,620 to Mindrum et al granted Nov. 16, 1965, discloses a roadway maintenance apparatus that is intended to eliminate the need for several vehicles and a crew for roadway patching procedures. The vehicle includes a movable tool support head on an extended beam that can be controlled from an operator's station to project ahead of the vehicle to a defective roadway surface area.

Mindrum's tool head includes a boring or routing head, a repair material delivery head, a tamper or roller, and an airblast surface cleaner. Repair material is delivered to the movable tool head from a hopper on the vehicle frame via a telescoping delivery chute enclosing an auger. The tool head is selectively operable to pivot any one of the tools about a horizontal axis into an operative position.

Patching is accomplished with the Mindrum apparatus first by driving the vehicle into position behind the repair site. The operator then uses controls in the control cab to extend the tool head over the site, and to pivot the router down to an operative position. The router is then operated to cut through the roadway surface and prepare a cavity. An air blast is used to clean the cavity of loose material. The auger is used to deliver fresh repair material into the cavity. The tamper or roller is then pivoted into operative position to compact the repair material into the cavity and complete the repair. A brush on the vehicle frame may then be used to clean away excess repair material.

U.S. Pat. Nos. 3,625,120 and 4,215,949 show vehicles having hoppers for containing and heating asphalt. The '49 patent describes the use of a hot air blast for cleaning a prepared cavity in preparation for receiving patching material. A tamper is provided for tamping the material. The '49 patent also shows use of an auger for supplying material from the hopper to a loading position for loading the material in a bucket arrangement. The '20 patent shows a hopper having a screw feed for feeding material to a nozzle at the front of the vehicle. A rake is provided for raking the material into a prepared cavity. A roller is mounted at the back of the vehicle frame for finish rolling the patching material.

U.S. Pat. No. 3,564,985 refers principally to a heating system for heating highway repair material over a broad surface prior to the addition of either an additional layer or the addition of asphalt resin material.

U.S. Pat. No. 2,732,197 shows a tamper movably carried on a pivoted frame.

U.S. Pat. No. 1,714,659 is principally concerned with supplying material to a patching site. However, of some interest is the fact that it discusses the possibility of adding old asphalt to the machine as the roadway surface is being cut from the roadway so as to provide some economy in the patching cost.

U.S. Pat. No. 4,172,679 to Wirtgen discloses a renewing device for road surfaces in which a number of individual surface repair tools are rigidly mounted to the vehicle frame forward of the operator's control cab. The vehicle must be moved to bring the various tools into position over the repair site and then carefully moved again to move the tools within the repair area.

The Mindrum machine and other roadway repair apparatus of knowledge do not include a vacuum system for pickup of roadway materials routed from a relatively deep cavity. It is desirable to vacuum routed materials and deposit them into a hopper for return to an asphalt aggregate mix plant for reuse. It is also desirable to provide for dust-free operation during cutting and routing a repair cavity, a completely cleaned repair area, and an economic factor resulting from reuse of the routed roadway aggregate.

The Mindrum machine and other roadway repair apparatus of knowledge do not embody a water vacuum system which will remove water or melted ice from a pothole, broken roadway shoulder or frostboil. Nor do any provide a movable torch for completely drying a roadway cavity to permit proper and lasting repair during any season or inclement weather condition.

The Mindrum machine and other roadway repair apparatus of knowledge do not embody a tack coat spray applicator for securely bonding repair aggregate to the routed cavity walls. They do not include a ram for tamping the routed cavity base which is required to eliminate sinking of the repaired area during traffic use. Nor do they include mounting of all repair tools on a carriage for controlled forward and back, side to side, and up and down movement within full view of the operator and within confinement of the vehicle framework. This provides for precise, level and accurate thrust control of all operating tools. They do not embody thermostatic heat control for maintaining accurate temperature control of the repair aggregate in the supply hopper and conveyors. It has been found that temperature control is desirable for proper application of the repair aggregate and its compaction into and adhesion to the repair cavity. They do not embody an inverted two-direction material spreader with applied heat for accurate and level spreading of the repair aggregate. Applied heat will cause the repair aggregate oil to surface, causing a dense and less porous repair surface.

All functions mentioned above and absent in known roadway repair apparatus are desirable for quick, timely, effective and complete repair of potholes, broken roadway shoulders, and frostboils during all weather conditions. A need, therefore, remains for a roadway repair vehicle that will perform all of these functions economically.

BRIEF DESCRIPTION OF THE DRAWINGS

The present invention is illustrated by the accompanying drawings in which.

DETAILED DESCRIPTION

In compliance with the constitutional purpose of the Patent Laws "to promote the progress of science and useful arts" (Article 1, Section 8), applicant submits the following disclosure of the invention.

Figure 1:
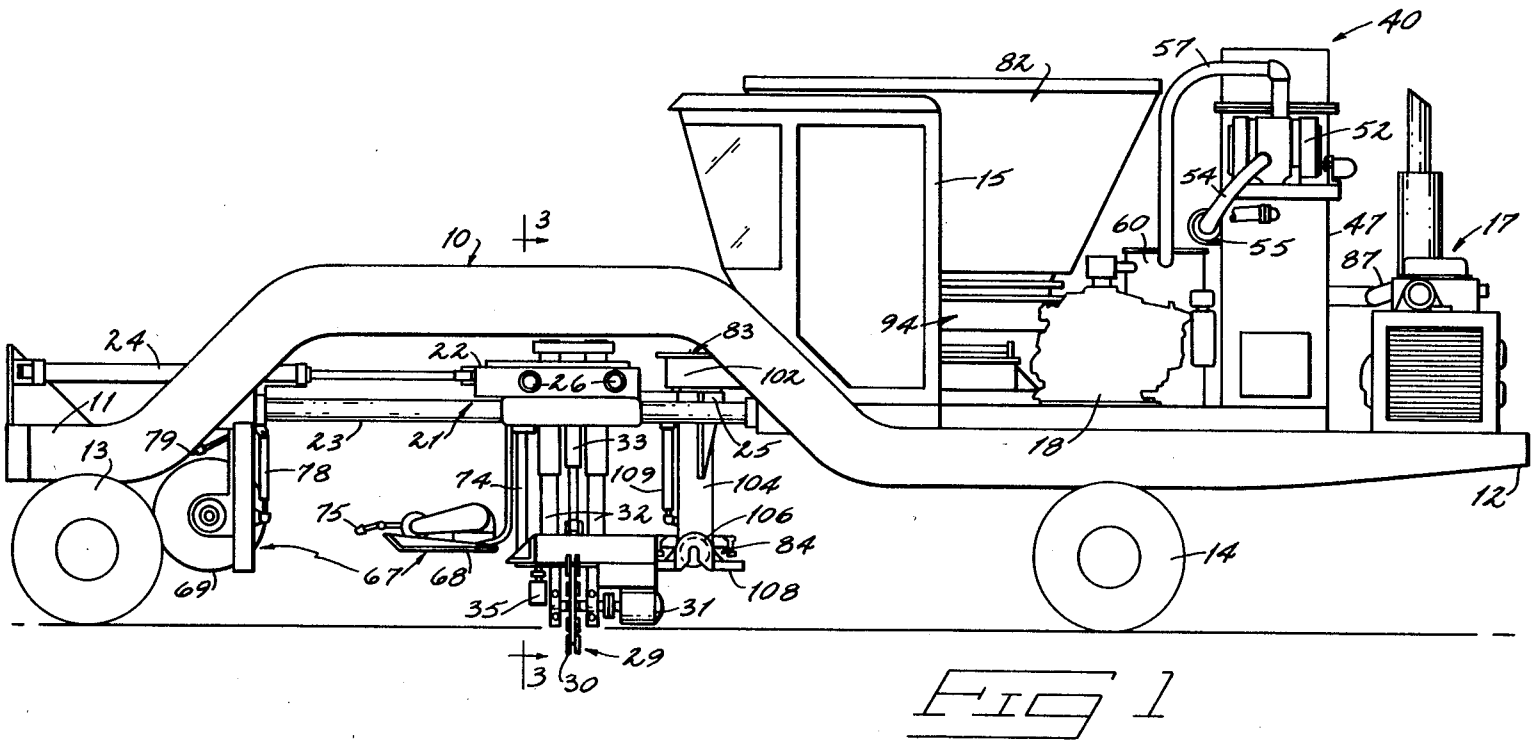
FIG. 1 is a side elevational view of the present vehicle.
Figure 2:
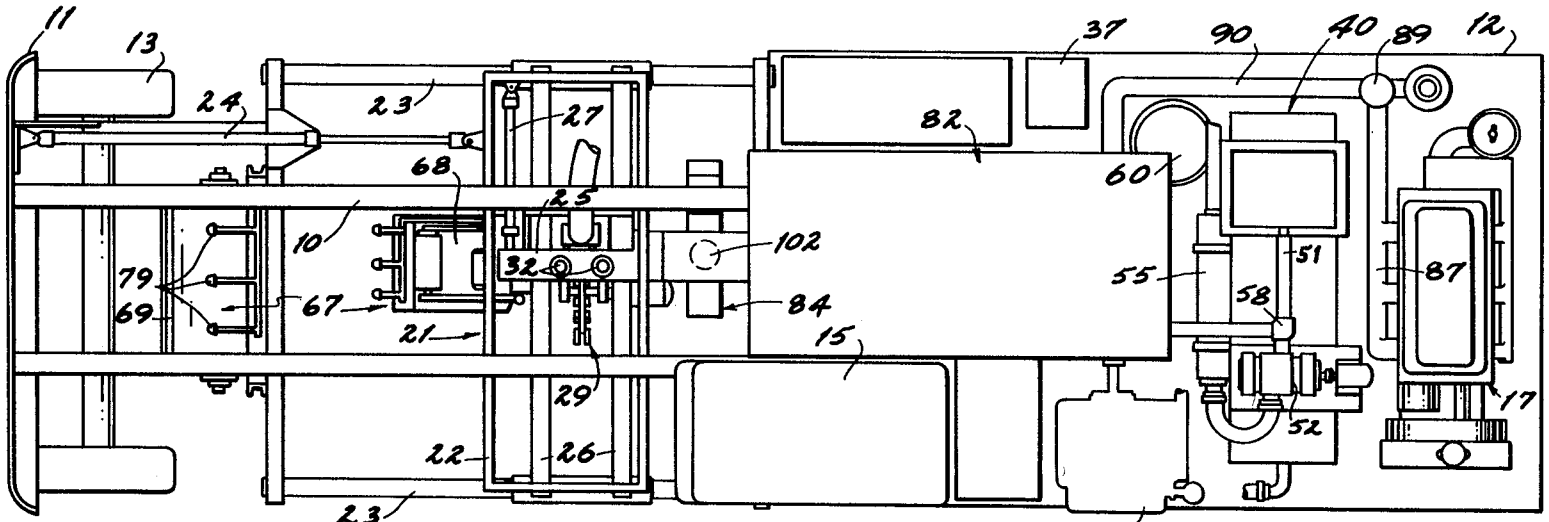
FIG. 2 is a top plan view thereof.

The present vehicle is generally shown in FIGS. 1 and 2 of the accompanying drawings. The present vehicle is a single operator utilized roadway patching vehicle. It travels the roads and highways from one location of road repair to another, positions itself, and performs complete roadway repair using a single operator.

The vehicle can be used for maintenance and repair of roadway surfaces formed from numerous different compositions, there being no practical limitation of the type of surface being repaired with regard to its material of construction. It is anticipated, however, that roads which are constructed of asphalt, bitumen, or macadam are roadways most likely to employ the present vehicle. The roadway repair material which is generally used, but to which use the present vehicle is not necessarily confined, may consist of an aggregate which should be heated to and maintained at a proper application temperature for best bonding, compaction, and adhesion. To this end, specific provisions are made within the present vehicle for receiving and maintaining temperature of such material.

It is anticipated that the present vehicle will find its greatest use in repairing roadway potholes, rutted surfaces, and broken shoulders which result from cold weather, frost boils, and heavy traffic use. It is to be understood, however, that use of the present vehicle is not limited to the correction of a particular type or location of roadway damage.

Since roadway damage does not occur uniformly and is characterized by separation of the damage over long distances, the present vehicle is self-propelled and can cover substantial distances to perform necessary repair operations wherever required. This makes it possible to minimize repair time and to reduce capital and equipment expenditures since the present vehicle controlled by a single operator can service a substantial length of highway.

It is well known that present methods of repairing damaged roadways can be performed only in warm weather. It is also well known that damaged roadway repair can only be performed in a lasting, permanent and even surface by firstly removing all of the broken and fractured materials from the damaged area and thereby providing a clean, solid and tamped subsurface cavity extending to solid, undamaged existing roadway surface. Elements embodied in the present single operator vehicle are operable to produce such a cavity, fill the cavity with prepared repair material and finish the repair to a lasting, smooth surface to the level of the existing undamaged surface regardless of weather conditions.

Repair work on highways such as filling ruts is often performed by time consuming and expensive hand operation procedures, often in which several specialized vehicles and a number of personnel are involved. The present vehicle will replace these crews and equipment and require only a single operator and one piece of equipment.

The operator can drive the present vehicle to a repair site and operate the repair tools to effect the needed repair. The present tools will prepare the damaged roadway by (a) routing it to a solid wall cavity bounded by solid existing roadway surface, (b) removing the routed material for reuse, (c) tamping the cavity subsurface, (d) applying a tack-coat adhesive to the cavity walls, (e) filling the cavity with roadway repair materials, then (f) tamping and rolling the material to a smooth roadway grade repair. All of these operations may take place within full view of the operator who can skillfully control the tools to perform these operations from within an enclosed cab.

It is possible, by use of the present vehicle, to economize on roadway repair operations by replacing a four to five person crew with a single operator who can cover greater distances, repair the roadway faster, and effect repair with a durable restoration regardless of the weather or season.

In the event that numerous areas need to be repaired at a given location, it is possible to park the present vehicle at a selected position, and, from that single position perform numerous repair operations at the same vehicle setting. This is done through use of a movable tool supported carriage which is carried by the vehicle so as to locate the necessary tools in their proper functional positions in relation to the surface to be repaired. Again, all this is accomplished within full view of the operator who is free to concentrate on the repair work without the distractions which would otherwise accompany steering a moving vehicle.

The present vehicle is shown in the accompanying drawings including an elongated wheel supported framework 10. For purposes of further description, it may be said the frame includes a front end 11 and a rear end 12. The front end is supported by a front pair of wheels 13 and the rear end 12 by a rear wheel pair 14.

The vehicle is powered for movement by an internal combustion drive means 17. An auxiliary drive 18 (FIGS. 1, 2) may also be provided as a source of power for operating the various elements described below.

An enclosed operator station 15 may be situated on the frame 10 toward the rear end 12. The station 15 may include appropriate controls (not shown) that facilitate complete operation of the various vehicle functions by a single operator. The station 15 is situated on the frame to optimize operator visibility of the roadway surface, both for maneuvering the vehicle when moving, and for viewing operation of the various tools during repair of the roadway surface.

Further explanation of specific controls for drive mechanisms are not believed to be necessary for a complete disclosure of the present invention. Such controls are readily available on the marketplace and are well known to those of ordinary skill in the art of power application and control. Further discussion and illustration of such mechanisms, for the sake of brevity, will not be made.

The vehicle frame provides support for a movable tool support carriage generally shown at 21. The carriage 21 is located on the frame between the front wheels 13 and the operator's control station 15. It includes a primary carriage frame 22 supported by longitudinal tubular supports 23 on the frame 10. The tubular supports 23 allow sliding longitudinal motion of the carriage 21 lengthwise along the frame. A cylinder 24 may be mounted longitudinally between the frame 10 and primary carriage frame 22. The cylinder 24 is operable from the operator's station 15 to move the entire carriage 21 longitudinally along the tubular supports 23.

A secondary carriage frame 25 (FIGS. 2, 3) is also included in the assembly of the tool support carriage 21. The secondary carriage frame 25 is mounted to the primary carriage frame 22 by lateral tubular supports 26. A cylinder 27 (FIG. 2) or other device such as a lead screw arrangement (not shown) may be oriented transversely between the primary carriage frame 22 and secondary carriage frame 25. Cylinder 27 is selectively actuated from the operator's control station 15 to effect lateral motion of the secondary carriage frame 25 transversely across the roadway surface. Various tool heads described below are mounted to the secondary carriage frame 25 in full view from the operator's station 15 for operation on the roadway surface and for movement with the carriage frame in longitudinal (forward, backward) and transverse (side-by-side) directions.

The cylinders 25 and 27 can be operated separately or in unison from the operator's station 15 to position the carriage and equipment mounted thereto at any selected site within the dimensions of the tubular supports 23 and 26. This entire area is visible from the operator's station 15 and is confined in full view from the operator's station 15 within the frame 10. The frame 10 can therefore be used to bear directly against any selected tool on the carriage and thereby assure firm and positive tool control.

A first tool mounted to the carriage 21 for selective movement therewith is a cutter head shown generally at 29. The cutter head shown includes a cutter wheel 30 that is powered to rotate about a horizontal axis by a drive motor 31. It is noted that the cutter head (FIGS. 9, 10) may also be in the form of a router, rotated on a vertical axis. Other forms of cutter could be utilized as well. However, it has been found that the forms illustrated are serviceable in performing roadway surface cutting operations. The cutter wheel 30 is especially adapted for use in conjunction with a vacuum head 39 that is described in greater detail below.

Figure 3:
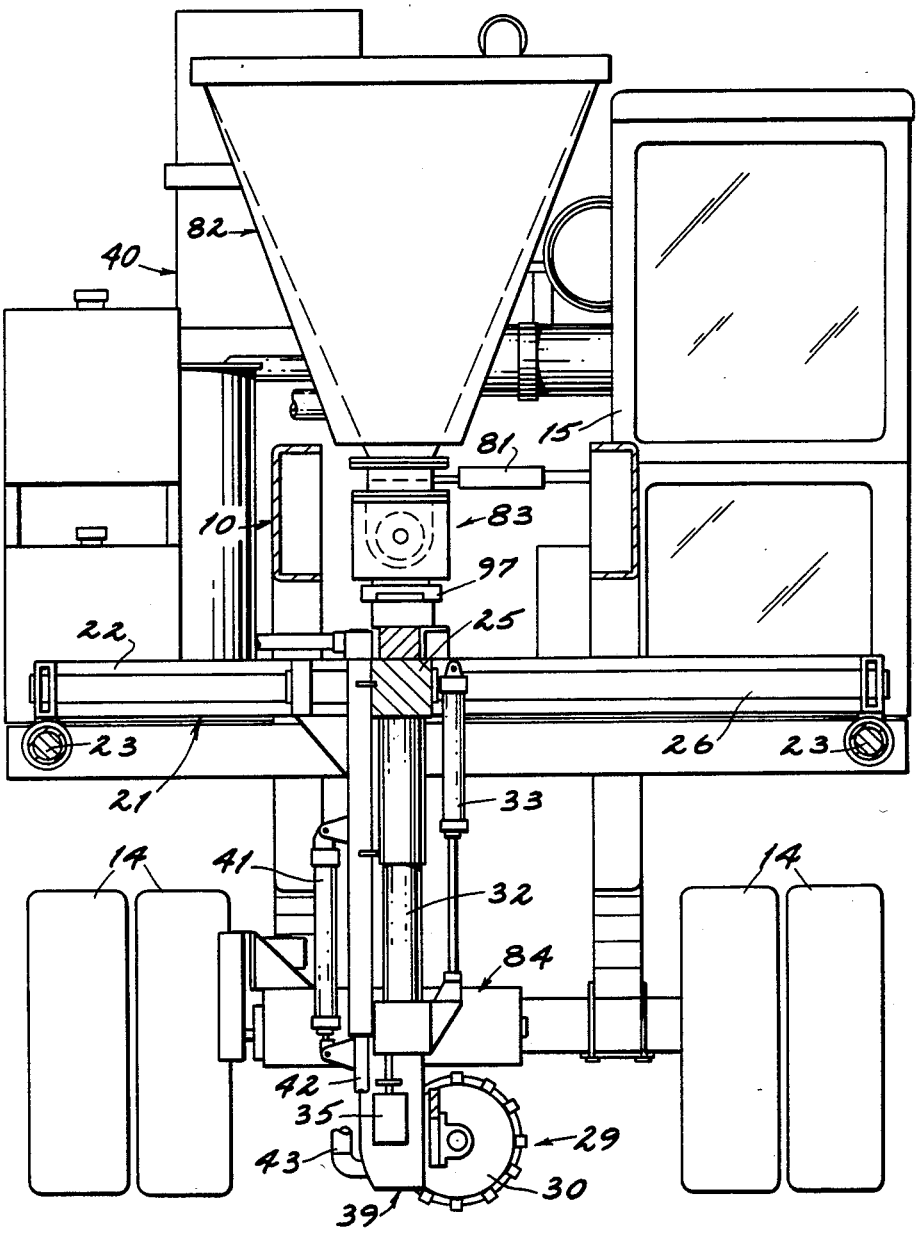
FIG. 3 is an enlarged frontal section through the vehicle frame taken substantially along line 3—3 looking rearwardly at a tool support carriage of the present vehicle.
Figure 4:
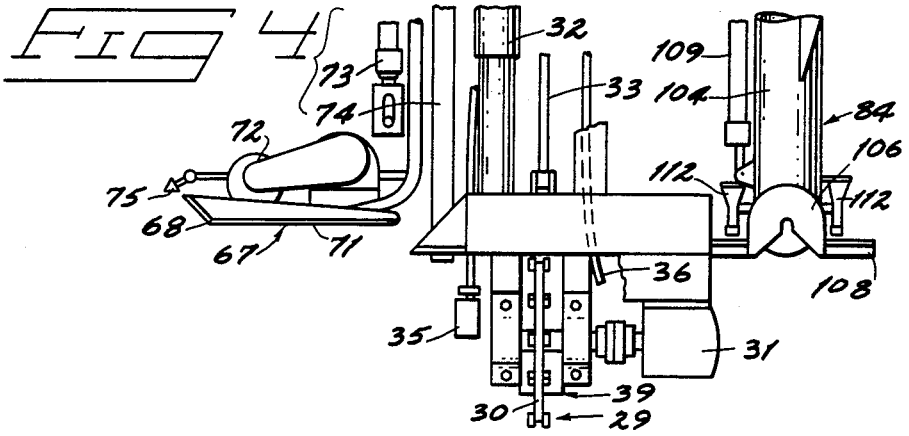
FIG. 4 is an enlarged fragmentary view of specific tools carried on the tool support carriage.
Figure 5:
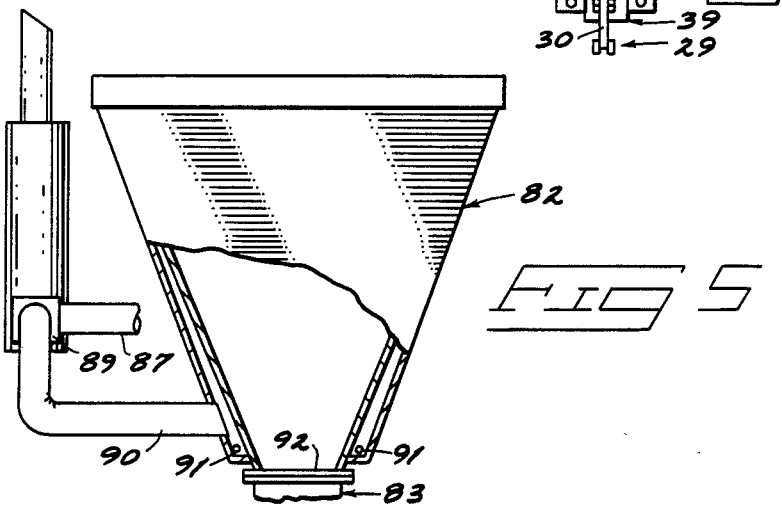
FIG. 5 is a fragmentary detail view of a double wall hopper and engine exhaust heating system for the hopper.
Figure 6:
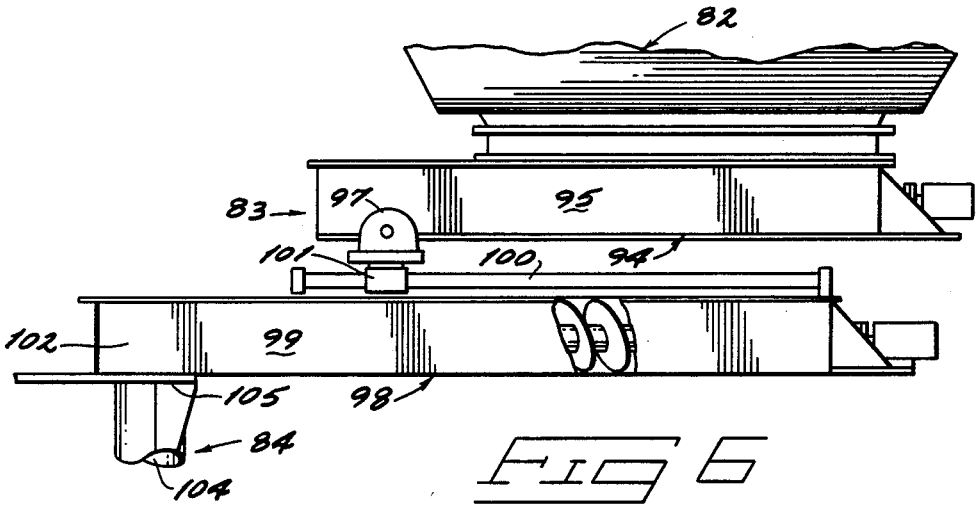
FIG. 6 is an enlarged fragmentary detail of delivery mechanisms leading from the hopper shown in FIG. 5.

The cutter head 29 of FIGS. 3 and 4 is mounted to the secondary carriage 25 by upright tubular supports 32 that allow vertical motion of the cutter wheel 30. Such vertical motion is selectively caused by cylinder 33, mounted between the secondary frame 25 and the cutter head 29. The cylinder 33 may be actuated by an appropriate control from the operator's station 15.

It is noted that the cutter head shown in FIGS. 3 and 4 is mounted for rotation about a horizontal axis and that the axis is situated longitudinally with respect to the vehicle frame. It is noted, however, that the cutter head 29 of FIGS. 3, 4 may also be independently mounted to the secondary frame 25 by an individual powered turret mechanism (not shown) that could be selectively operated to pivot the cutter head 90° about a vertical axis. Such provisions may be desirable in specific applications although it has been found that such pivotal motion of the cutter head is not required when a cutter wheel or router having axial cutting capability is used. Such axial motion is produced by operation of the longitudinal cylinder 24. Lateral motion of the cutter head is effected by the cylinder 27.

The cutter head 27 is used to cut through an existing roadway surface of varying depths to form a prescribed cavity for filling by a selected roadway repair material. Vertical motion to determine the depth of the cavity is controlled through the cylinder 33 or a lead screw assembly shown in FIG. 10 and described further below. Longitudinal and lateral motion is controlled through the cylinders 24 and 27 respectively to determine the length and breadth of the cavity.

A spread flame torch or burner 35 is mounted to the tool support carriage 21 adjacent to the cutter head 29. The spread flame burner 35 is supplied with a combustible gas such as propane for the purpose of drying and warming the interior surfaces of a cavity formed by the cutter head. It may also be used to melt ice from a broken or damaged road surface area. The melted ice may then be picked up and the area dried by the burner. This facility provides means for making a good and permanent road repair in almost any kind of weather. A warm, dry surface within the prepared cavity and adjacent roadway surface aids in bonding of an applied "tack-coat" and in bonding of the new roadway repair material with the existing roadway surface and underlying strata.

A tack-coat spray nozzle 36 may also be positioned on the tool support carriage 21 in order to direct a spray of an appropriate liquid adhesive material into the cavity prepared by cutter head 29. The tack-coat applied to the cavity surfaces assures proper adherence of the later applied roadway repair material. The tack-coat material may be supplied under pressure from a conventional holding tank and fluid pump mechanism 37 (FIG. 2).

An important feature of the present invention is a vacuum head 39 that is also mounted to the tool support carriage 21 adjacent to the cutter head 29. The vacuum head 39 shown in FIGS. 3 and 4 is adapted to directly receive surface fragments loosened from the roadway surface by the cutter head. It may also be utilized independently of the cutter head to receive and remove other materials including water or excess roadway repair material from the roadway surface. It is preferred, with the cutter wheel 30 of FIGS. 3 and 4, that the vacuum head be normally positioned in relationship to the cutter head to directly receive material broke loose by the cutter head during operation. To this end, the vacuum head 39 is positioned "rearwardly" adjacent the cutting wheel to catch materials thrown upwardly from the roadway surface by the upwardly rotating teeth of the cutter wheel.

The vacuum head 39 shown in FIGS. 3 and 4 is mounted to the tool support carriage 21 for vertical movement independently of the cutter head. To this end, an upright cylinder 41 (FIG. 3) is mounted between the secondary carriage frame 25 and the vacuum head 39. Operation of the cylinder 41 from the control station 15 will cause corresponding upward or downward movement of the vacuum head along tubular supports 42. The vacuum head can therefore be extended below the cutter head 29 to facilitate operation in vacuuming debris from within a formed cavity or for independent operation of the cutter head to clean debris and excess roadway repair material from the roadway surface.

A collector means 40 is operatively connected to the vacuum head for supplying vacuum pressure through the vacuum head to collect loosened fragments removed by the cutter head. The collector means may also include provisions (described below) for collecting and storing water.

Figure 8:
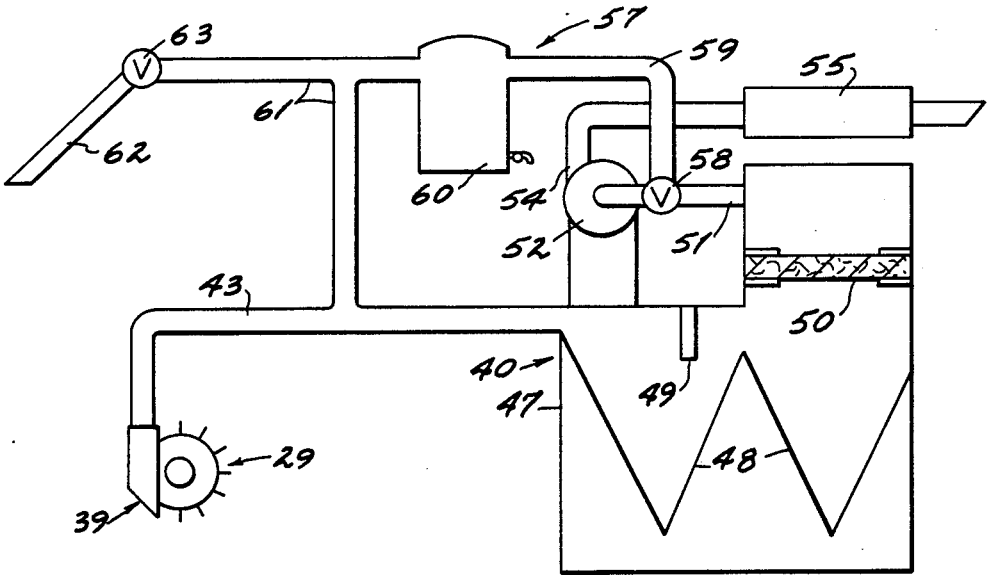
FIG. 8 is a diagrammatic view of a vacuum system for cleaning debris and excess roadway repair material from the roadway surface.

The collector means 40 is shown in schematic form in FIG. 8. A vacuum line 43 is there shown leading from the vacuum head 39 to a collector tank or hopper 47. Loosened roadway surface fragments are directed through the vacuum line 43 and into the hopper 47 for storage and removal at a later time to facilitate recycling of the collected material. The surface fragments may therefore be retained to maintain a clean repair area and for the additional purpose of returning the used material to an aggregate blending plant for reuse.

The hopper 47 includes a double "V" bottom 48 and baffles 49 that are positioned to separate routed roadway fragments from the vacuum air. Heavy materials routed from the roadway repair cavity and conveyed into the hopper 47 will impinge on baffles 49 to be deflected to the hopper bottom. The baffles 49 thereby cause the hopper to function as a separator of the fragmented materials from its conveyance air. "Baghouse" air cleaner filters 50 mounted to the hopper 47 perform a final cleaning of the vacuum system air before it is expelled to the atmosphere. The filters protect against foreign material entering an intake line 51 to a high pressure vacuum pump 52.

Discharge air is delivered through a discharge line 54 which includes a muffler 55 for substantially silencing the attendant high pitch noise typically produced by the pump 52 and associated vacuum system.

A water collector means 57 may be provided in conjunction with the remainder of the vacuum system described above. The water collector means 57 is selectively operable to receive water drawn through the vacuum head 39 or, alternately, through a hand held wand 62.

The water collector means 57 includes a selector valve 58 mounted within the pump intake line 51. The valve 58 can be operated to divert suction from the hopper 47 to a water vacuum line 59. The line 59 is connected through a water collection tank 50.

The water tank 60 is of sufficient volume to receive and store considerable amounts of water collected from the roadway surface area during adverse weather conditions. Water within the tank can be later drained at a more convenient location. Alternatively, the water can be recycled through appropriate mechanisms (not shown) for further use in conjunction with the surface patching elements of the present vehicle. In freezing weather, antifreeze is injected into the water collector tank to eliminate freezing.

A water vacuum line 61 extends from the tank 60 to the hand held wand 62 and to the primary air vacuum line 43. A valve 63 may be provided on the wand 62 to allow selective operation of the wand together with or independently of the vacuum head 39. It may therefore be understood that the wand 62 and vacuum head 39 may be used separately or together for the purpose of suctioning water from the repair area of the roadway.

A finishing means 67 is provided on the tool support carriage 21 for preparing a new "finished" roadway patch or repair along the roadway surface. Finishing means 67 may basically include a tamper head 68 on the tool support carriage 21 or a pressure roller 69 on the frame 10, or preferably both.

The tamper head 68 includes a relatively flat, horizontal pad 71 (FIG. 4) situated forwardly of and adjacent to the cutter head 29 and spread flame burner 35. A vibrator motor 72 is mounted on the pad to cause high frequency impaction vibration along the pad. The pad 71 and vibrator motor 72 are vertically movable independently of the cutter head 29 and vacuum head 39 by means of an upright cylinder 73. The cylinder 73 may be operated from the control station 15 to lift or lower the pad 71 along upright tubular supports 74.

Water nozzles 75 may be provided along the pad so a fine water spray may be directed downwardly against the roadway surface for cooling purposes and to avoid material adhering to the operative pad surface. Water for the nozzles 75 may be supplied by an independent storage tank or from the water collector tank 60.

The tamper head 68 can be used both to prepare the cavity to receive new roadway repair material, and to tamp and flatten the surface of the applied roadway repair material after it has been received within the cavity.

The pressure roller 69 briefly mentioned above is mounted to the frame 10 in full view from the operator's control station 15 intermediate the tool support carriage 21 and front wheels 13. A cylinder 78 is operatively mounted between the pressure roller 69 and frame 10 to effect vertical motion of the roller between an inoperative position clear of the roadway surface and an operative position braced firmly against the roadway surface. The nature of the pressure produced through the roller 69 is such that it is impractical to mount the roller for longitudinal movement along the frame. Therefore, the rolling operations may be accomplished by lowering the roller into engagement with the roadway surface and subsequently moving the entire vehicle and roller over the selected area. Provisions may be made to make the roller vibratory.

Water spray nozzles 79 may be provided adjacent to the pressure roller 69. The spray nozzles 79 deliver water onto the roller surface for the purpose of cooling or preventing adhesion of roadway repair material to the roller surface. The spray nozzles 79 may be connected to the same source as the nozzles 75 used in conjunction with the tamper head 68.

Roadway repair materials are carried on the present vehicle frame 10 within a hopper 82. The hopper receives and stores roadway repair material for transport to selected repair sites and for supplying the material through a delivery means 83 to a material applicator head 84 on tool support carriage 21.

The hopper is preferably formed in a double wall construction in which the inside surface of the hopper outer wall includes an insulating material. Exhaust from the internal combustion drive means 17 may be diverted to the area between the double walls of the hopper from the engine exhaust 87 (FIG. 2). This may be done through a deflector means 89, thermostatically operable to deflect exhaust from the exhaust discharge pipe 87 into an auxiliary heating system pipe 90 leading to the confined chamber between the double walls of the hopper. The auxiliary heat system as provided above makes use of heated exhaust gases to heat the hopper and roadway material contents and thereby maintain a selected material temperature. Thermostatically controlled propane heaters 91 situated within the double wall hopper structure may also be utilized in cold weather conditions or in other situations where the engine exhaust temperature is insufficient to maintain temperature of the roadway repair material held within the hopper 82.

Hopper 82 converges downwardly to a bottom end 92 that includes flow control openings for delivery of the roadway repair material to the delivery means 83. Flow control of repair material from hopper 82 to delivery means 83 is controlled by a cylinder gate 81 (FIG. 3).

The delivery means 83 includes a first auger trough conveyor 94 mounted at the bottom hopper end 92. The trough conveyor 94 includes a longitudinal conveyor trough 95 enclosing an auger for reception of material from the hopper and delivery thereof to a swivel tube 97.

The swivel tube 97 is situated at a forward end of the trough 95 for movably mounting a second auger trough conveyor 98. The second trough conveyor 98 includes an elongated upwardly open trough 99 mounted by guide support tubes 100 to slide collars 101 on the swivel tube 97. The collars allow sliding motion of the second auger conveyor along the full length of the guide support tubes 100 relative to the swivel tube 97. Furthermore, the swivel tube 97 facilitates free pivotal movement of the second auger conveyor 98 about a vertical axis. Both conveyor troughs may be double walled (FIG. 11) similarly to the hopper to receive heated air from the heaters 91 to maintain temperature of repair material during transit.

The second auger conveyor 98 leads forwardly to an end that may be defined as a discharge end 102 of the delivery means 83. This end 102 is attached to the roadway material applicator head 84 for delivery of material from the second auger conveyor to the applicator head.

Material received from the discharge end 102 of the delivery means 83 is received by an upright telescoping chute 104 of the applicator head 84. A swivel mount 105 is provided at the top end of the chute 104 to provide pivotal attachment of the second auger conveyor 98 to the chute. This pivotal connection secures the conveyor 98 by its discharge end 102 to the tool support carriage 21.

Movement of the carriage 21 will cause corresponding sliding or pivoting motion of the second auger conveyor 98 below the swivel tube discharge 97 of the first auger conveyor 94. Motion of the second auger conveyor 98 may be continuous without interruption of material flow to the applicator head 84. Thus, the tool support carriage 21 and attached elements may be moving simultaneously with delivery of material to the applicator head 84. This facilitates reception and spreading of roadway repair material over substantial areas if so desired.

Figure 7:
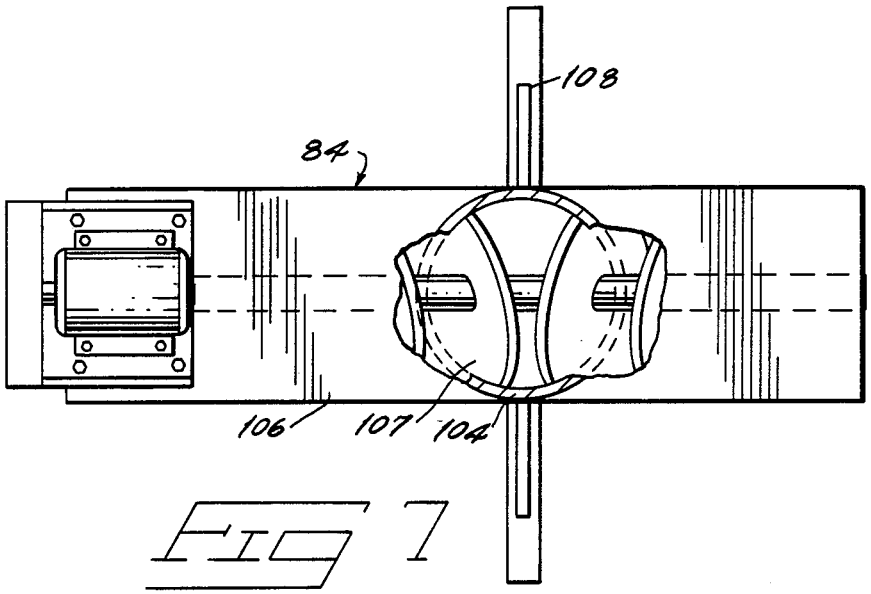
FIG. 7 is a detail view of an applicator head and material spreader.

The applicator head chute 104 leads substantially vertically to an inverted trough 106. The trough 106 houses a rotatable two way auger 107 (FIG. 7). The auger 107 has diverging flights from its center to receive and spread roadway repair material over a prescribed area. This avoids concentration of the material in individual piles and facilitates quick and accurate spreading of the material to produce an even and consistent patch.

To further assist spreading of delivered material, a striker bar 108 is provided on the applicator head 84. The striker bar 108 can be moved by motion of the tool support carriage 21 to engage and grade deposited roadway repair material to a selected level. An inverted burner 112 applies heat to the striker bar to raise the oils of the repair material to produce a less porous finished repair surface.

A cylinder 109 shown in FIGS. 1 and 4 is mounted between the tool support carriage 21 and the chute 104. The cylinder may be operated from within the operator control station to raise or lower the applicator head 84 independently of the remaining tools mounted on the carriage 21. The striker bar 108, rigidly mounted to the trough 106, will also move elevationally in response to operation of the cylinder 109.

Figure 9:
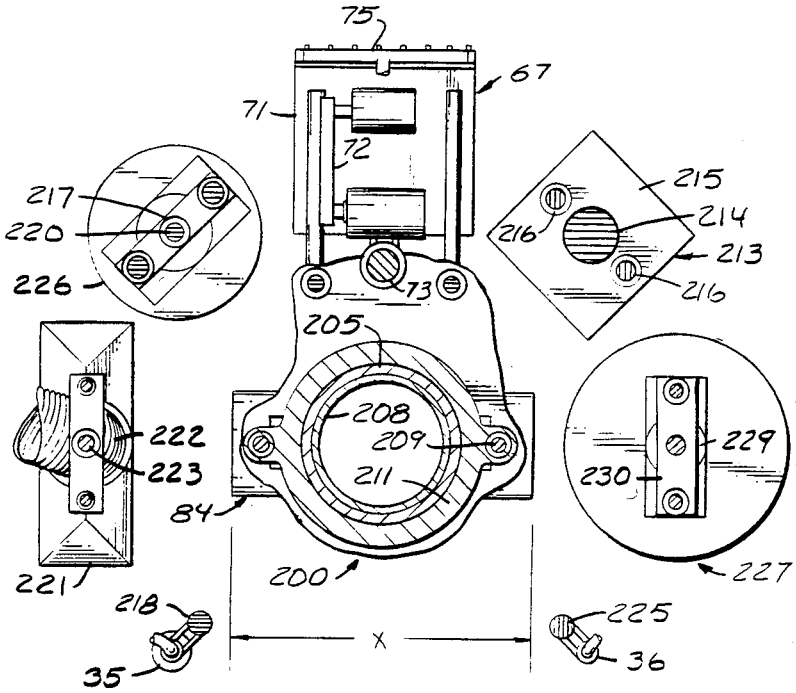
FIG. 9 is a fragmented sectional view showing various tools mounted to a turret head arrangement, the section being taken substantially along line 9—9 in FIG. 10.
Figure 10:
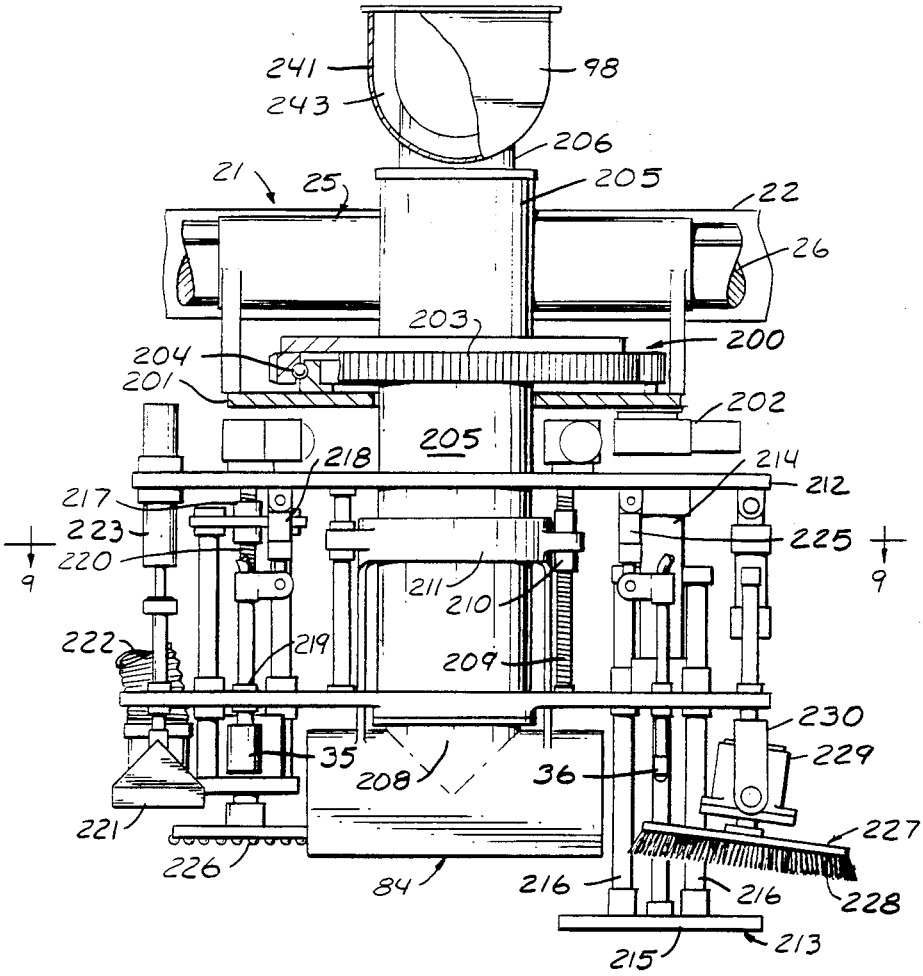
FIG. 10 is an elevational view of the turret mechanism and tools mounted thereto.

FIGS. 9 and 10 show an arrangement by which the various tools supported from the carriage 21 and described above are mounted for rotational movement about an upright axis by a turret means 200. FIGS. 9 and 10 also show variations in the tool mounts and additional tools for effectively performing patching operations by a single operator in direct view from the operators control station 15.

The turret means 200 includes a stationary base 201 rigidly mounted to the secondary carriage frame 25. A drive motor 202 is also mounted to the base and includes a pinion for meshing engagement with a ring gear 203. The ring gear 203 is mounted by a bearing 204 to the stationary base. It will rotate in response to operation of drive motor 202 about an upright axis.

A central tubular support 205 is mounted to the ring gear for rotation therewith. This support 205 carries the various tools shown for rotation about the upright axis.

The tubular support 205 is hollow and connected by a swivel connection 206 to the discharge of the second auger conveyor 98. An inward telescoping tube 208 is slidably received within the support tube 205. It mounts, at a lower end, the applicator head 84. The applicator head 84 is therefore centered substantially on the upright rotational axis for the turret means.

The applicator head can be raised or lowered by a vertical, motor driven lead screw 209 secured by a flange 212 to the central tubular support 205. A nut 210 threadably engages the lead screw 209. The nut 210 is attached by a bracket 211 to the applicator head. Revolution of the lead screw 209 will therefore raise or lower the material spreader between a raised, inoperative position and a lowered, operative position.

A ram tamper 213 is also mounted via the flange 212 to the central tubular support of the turret means 200. The ram tamper is mounted by a vertical cylinder 214 to the tube. The cylinder can be operated from the control station 15 to raise or lower a tamper plate 215. It can thus be extended to press the plate 215 firmly down into a cavity. The force applied will serve to firmly compact the materials found in the bottom of the cavity to prepare the bottom cavity surface for receiving repair materials. Guides 216 are provided to direct vertical movement of the plate in response to extension and retraction of the cylinder 214.

FIGS. 9 and 10 also illustrate a cylinder lift 218 supporting the spread flame burner 35. The cylinder can be actuated independently to raise or lower the spread flame burner 35 along a vertical guide 219 (FIG. 10). Cylinder 218 facilitates insertion of the burner into the cavity for drying and warming purposes as discussed above.

A form of vacuum head 221 is also mounted to the turret 200. Vacuum head 221 includes a flexible vacuum line 222 vertically movable with the head 221 by means of a lift arrangement 223.

The vacuum head 221 is mounted independently of and spaced from the router type cutter head 226 shown in FIG. 10. The vacuum head can be therefore raised and lowered independently of the cutter head to engage and remove particulate material and liquids from the surface of the roadway surrounding the cavity and can be lowered into the cavity to remove loose materials found therein. The shape of the vacuum head can vary but should be sufficiently small to be inserted into and moved about within the cavity.

The cutter head 226 may be mounted to the turret by a lead screw_arrangement similar to that provided for the applicator head. A lead screw 220 is rotatably journalled on the flange 212 and driven by an appropriate motor. A nut and guide assembly 217 mounts the cutter for vertical motion in response to rotation of the lead screws.

A rotary brush means is shown at 227 in FIGS. 9 and 10. The rotary brush means is mounted to the turret means 200 for selective rotation therewith about the upright axis. It includes a circular bristle brush 228 (FIG. 10) that may be inclined slightly for the purpose of brushing excess roadway repair material into the cavity filled by the applicator head 84. The rotary brush means is mounted to the rotatable tubular support 205 by a cylinder or other appropriate selective lift device 230 for movement between lifted inoperative and lowered operative positions.

FIGS. 9 and 10 also show a lift device 225 mounting the tack spray nozzle 36 to the turret. The lift 225 facilitates movement of the spray nozzle 36 into and out of the cavity.

The vibrating tamper head 68 may also be mounted to the turret flange 212 as shown in FIG. 9. It may include similar mounting and drive arrangements as described eariler in this specification.

FIG. 9 diagrammatically illustrates the angular positioning of the various tools described above about the central rotational axis for the turret means 200. The applicator head 84 is situated in coaxial relation with this axis to receive roadway repair material from the delivery means. It may be positioned in full view from the operator's station 15 due to the specific angular arrangement of the remaining tools about the central axis. An area indicated at "X" can be pivoted with the turret into full view from the operator's station 15 of the applicator head when it is situated at an operative position.

The turret means 200 can be selectively operated from the operator's control station 15 to selectively pivot any of the tools mounted thereto into an operative position in clear view from the operator's station. The operator can pivot a selected tool into this position, lower the selected tool to perform its specific function, then raise it to an inoperative position while the tool and the repair area remain within full view. This is very important to facilitate optimum use of the tools and accuracy in affecting the needed repair.

Figure 11:
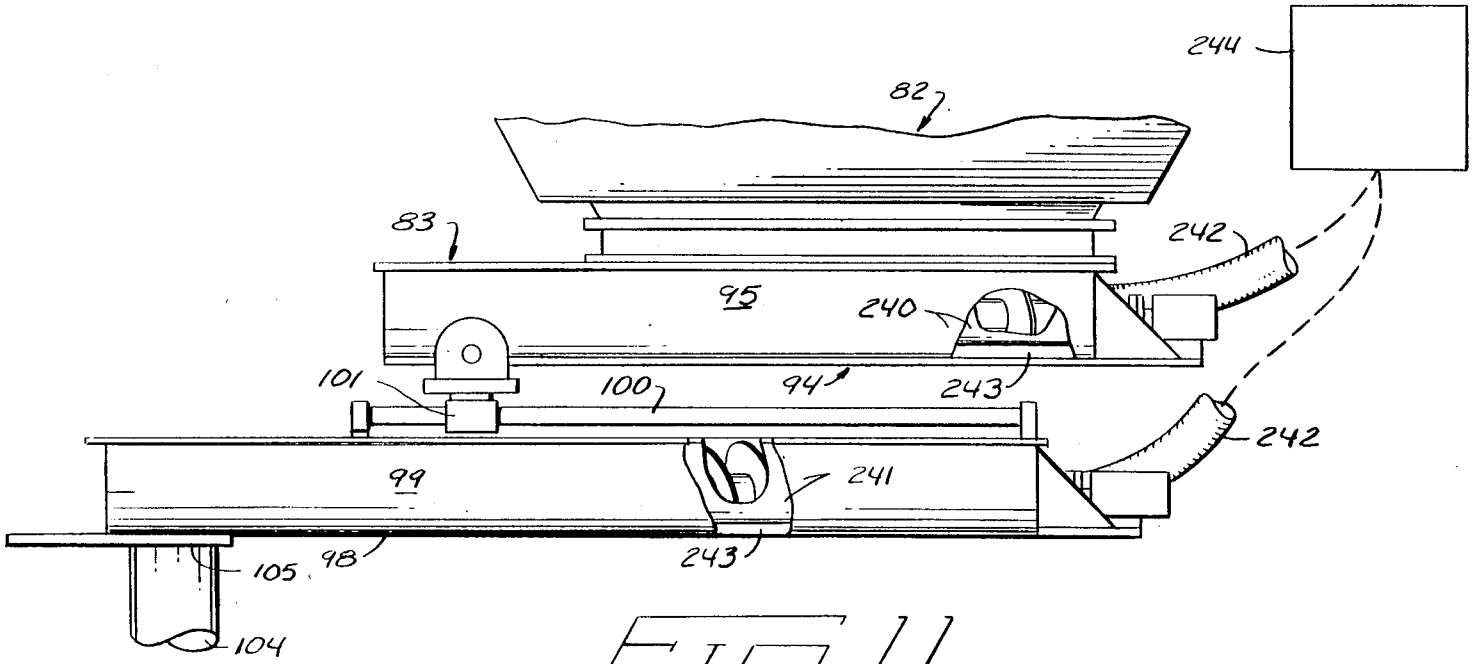
FIG. 11 is a fragmented elevation view showing a material delivery means and associated heating mechanism.

FIG. 11 is illustrative of a modified form for the first and second auger trough conveyors 94, 98. They include double walled trough arrangements 240, 241 for the purpose of including an internal plenum chambers 243 similar to that provided for the hopper 82. Flexible ducts 242 may be provided, leading to the plenum chambers within the trough conveyors. They may be connected to an auxiliary hot air heater schematically shown at 244 for supplying heated air to the plenum chambers. The heater 244 can be thermostatically controlled to maintain desired temperatures within the auger conveyors. This will maintain the repair materials within the auger conveyors in a warm, flowable condition. This is especially desirable when the vehicle is in transit from one repair site to another. It is also desirable in cold climate conditions when the roadway repair material could otherwise cool and clog the auger conveyors.

Having thus described the present invention in substantial detail, operation thereof may now become more easily understood. For example, it should be obvious from the above description that the present vehicle can be accurately operated from the operator's control station 15 to effect roadway repair while the vehicle remains in a stationary position. However, the vehicle may be operated to move from one location of repair to another. All operations described herein require a single operator and the elements comprising the present vehicle as described above.

A normal sequential function of the present vehicle may occur as follows. Firstly, the operator may position the vehicle in the area needing repair. In doing so, he or she will maneuver the vehicle so the area in need of repair is situated below the effective area covered within the range of movement for the tool support carriage 21. The vehicle is then stopped and may remain stationary while the repair functions are completed.

All horizontal operational motions of the various tools may be initiated from the vehicle operator's control station 15 via the cylinders 24, 27. The turret means 200 can be used to bring a selected tool into full view from the operator's station and to hold the tool in position on the carriage 25. The cylinders 24, 27 can then be used to move the carriage 26 about the repair area with the tool in use remaining in full view during operation as held by the turret means 200.

When required, ice and snow may be melted in and around the damaged area by means of the spread flame torch or burner 35. Melted ice or standing water may be removed by the water collector means 57. This may be done after using the turret means 200 to rotate the burner 35 into clear view of the operator's station 15 and selectively lowering it to the damaged area. The cylinders 24, 27 can then be used to move the burner about the repair area.

When the area is reasonably dry, the cutter head may be moved into position and operated to route all broken and fractured roadway material, thereby forming a open cavity through the roadway surface. The routed roadway material may be picked up as it is loosened by the vacuum head 34 and is delivered to the collector tank for possible later reuse. The vacuum head 221 may be used following the routing operation by rotating it via the turret means 200 into position and lowering it into the routed area.

Either form of the vacuum head assures a clean cavity and repair area. Should the operator observe any loose material within the cavity after operation of the cutter head, appropriate controls can be used to lift the cutter head and lower the vacuum head into the cavity. The vacuum head can then be operated to remove any excess material to completely clean the cavity.

At this point, the spread flame burner 35 may again be used to dry and warm the prepared walls of the cavity prior to application of the roadway tack coat. A fast drying asphalt or chemical compound tack coat is sprayed through the tack coat spray nozzles 36 onto the clean cavity walls. This provides a bond between the cavity walls and the new repair material to be installed. The turret means 200 can again be used at this point to bring the burner into full view from the station 15.

The cavity subsurface or bottom may then be tamped with the ram tamper 213 or tamper head 68 or both. This provides a solid base for the new roadway repair material and eliminates sinking of the repair material.

The turret can now be operated to rotate the tools such that the applicator head can be clearly viewed through the space "X" shown in FIG. 9.

The roadway repair material is conveyed via the delivery means 83 and applicator head 84 into the repair cavity. It is then compacted by tamping and scraping (using the tamper head 68 and striker bar 108) for additional compaction and leveling to the existing roadway level. Water, which may be chemically blended to eliminate freezing in cold weather, may be applied to the tamper pad to provide a smooth repair surface and provide cooling in cases where hot mix repair materials are used.

Any excess repair material delivered to the repair cavity may be scraped aside prior to compacting and final rolling. This surplus material may be picked up by the vacuum head and deposited into the collection hopper 47 for reblending and reuse. Alternatively, the brush means 27 can be operated about the perimeter of the mounded repair material to brush all loose material over the cavity prior to compaction.

The roller 69 can also be moved against the roadway surface and rolled across the repair area by starting and moving the vehicle. Water may also be used in conjunction with the pressure roller to provide a cooling effect and to prevent adhesion of the roadway material to the roller surface. Cooling afforded by the application of water may provide for quick traffic use of the repaired area without distortion.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A roadway patching vehicle for repairing broken or otherwise damaged roadway surface areas bounded by undamaged useful roadway surface, the vehicle comprising:

a wheel supported frame having a front pair of wheels at a front frame end and a rear pair of wheels adjacent a rear frame end;

an operator's station on the frame;

a tool support carriage on the frame between the front and rear wheels in view from the operator's station, selectively movable under the frame within an area substantially confined by the frame between the front and rear wheels and viewable from the operator's control station;

a roadway surface cutter head on the tool carriage for movement with the carriage and operable to cut through an existing roadway surface at a damaged area thereof to break the damaged roadway surface into loosened fragments and to form a cavity bounded by useful roadway surface;

torch means on the carriage for movement therewith for insertion into a roadway cavity to heat and dry exposed cavity surfaces;

a vacuum head on the carriage independent of the cutter head for insertion into a cavity formed by the cutter head to receive surface fragments from operation of the cutter head, existing surface water at the damaged area, or other debris or liquid found at the site of the damaged roadway surface area;

collector means on the frame operatively connected to the vacuum head for supplying vacuum pressure through the vacuum head to collect surface liquids or particulates including the loosened fragments removed by the cutter head;

a hopper in fixed position on the frame for receiving roadway repair materials;

extendible delivery means leading from a fixed end on the fixed hopper to a movable discharge end on the carriage, for movement responsive to movement of the carriage and for receiving roadway repair material from the fixed hopper and delivering it through the movable discharge end;

an applicator head on the tool carriage for movement with the carriage for receiving material from the discharge end of the delivery means and for filling the cavity prepared by the cutter head; and finishing means on the carriage for movement therewith to prepare a new surface on the roadway repair material discharged by the delivery means.

2. The roadway patching vehicle as claimed by claim 1 further comprising:

internal combustion drive means on the frame operatively connected to wheels on the frame for selectively powering the frame to move along;

wherein said internal combustion drive means includes an exhaust system with a discharge pipe for discharging exhaust gases;

deflector means attached to the exhaust system, selectively operable to deflect exhaust from the discharge pipe; and an auxiliary heat pipe interconnecting the deflector means and hopper for receiving deflected exhaust gases through the deflector means and dispensing the deflected gases to the hopper to heat the hopper and its contents.

3. The roadway patching vehicle as claimed by claim 1 wherein the finishing means is comprised of:

a tamper head mounted to the carriage for movement therewith and operable to tamp roadway repair material applied by the applicator head.

4. The roadway patching vehicle as claimed by claim 3, wherein the finishing means is further comprised of a pressure roller head on the frame in view from the operator's control station, for pressing roadway repair material delivered into the cavity through the applicator head to form a repaired roadway surface.

5. The roadway patching vehicle as claimed by claim 1 wherein the applicator head is comprised of:

a roadway repair material spreader connected to the discharge end of the delivery means, for evenly distributing received roadway repair material over a prescribed area.

6. The roadway patching vehicle as claimed by claim 1 wherein the applicator head includes a striker bar mounted thereto for movement with the tool carriage for roughly leveling roadway repair material delivered through the applicator head; and means for heating said striker bar.

7. The roadway patching vehicle as claimed by claim 1 wherein the vacuum head is mounted to the tool carriage for selective vertical movement thereon in relation to the cutter head and independently of the cutter head so it may be lowered into a cavity formed by the cutter head to remove liquids and debris therefrom.

8. The roadway patching vehicle as claimed by claim 1 wherein the collector means is comprised of:

a collection hopper on the frame adapted to receive and store roadway surface fragments loosened by the cutter head;

vacuum line extending between the collecting hopper and vacuum head; and water collection means including:

a valve in the vacuum line;

a water collection tank; and a water suction line leading from the water collection tank to the valve;

wherein the valve is operable to divert suction through the water suction line and into the water collection tank.

9. A vehicle for patching a damaged area of a roadway surface, comprising:

an elongated rigid frame having a front and a rearward end;

spaced front and rear pairs of wheels on the frame at the respective front and rear frame ends for movably supporting the frame along the roadway surface;

an operator's control station on the frame adjacent an end thereof;

a tool support carriage on the frame adjacent the operator's control station and between the front and rear wheels, selectively movable within an area below and confined by the frame from within the operator's control station;

cutter head means on the carriage for movement therewith selectively operable from the operator's control station for breaking the roadway surface into loose fragments and for preparing a cavity in the damaged area of the roadway surface;

repair material delivery means on the frame selectively operable from the operator's control station for delivering roadway repair material to a discharge on and movable with the carriage;

a hopper in fixed position on the frame for supplying repair material to the delivery means;

applicator means on the tool carriage for receiving repair material from the delivery means and for filling and spreading repair material within a cavity formed in a roadway surface by the cutter head means;

finishing means on the carriage for preparing a new surface on roadway repair material discharged through the applicator means, consistent with the existing roadway surface; and turret means on the carriage supporting the cutter head means applicator means and finishing means for selective pivoted movement about an upright axis to bring the cutter head, applicator or finishing means to an operating station in full view from the operator's control station.

10. The vehicle for patching a damaged area of a roadway surface as claimed by claim 9 further comprising:

a roller on the frame spaced from the tool support carriage adapted to be rolled over roadway surface and the repair material applied by the applicator means over the cavity.

11. The vehicle for patching a damaged area of a roadway surface as claimed by claim 9 wherein the finishing means is further comprised of:

a tamper head mounted to the turret means for movement therewith and selectively operable from the operator's control station to tamp roadway repair material along the roadway surface applied by the applicator means.

12. The vehicle for patching a damaged area of a roadway surface as claimed by claim 9 further comprising:

internal combustion drive means on the frame operatively connected to wheels on the frame for selectively powering the frame to move along;

wherein said internal combustion drive means includes an exhaust system for discharging exhaust gases through a discharge pipe;

deflector means attached to the exhaust system, selectively operable to deflect exhaust from the discharge pipe; and an auxiliary heat pipe interconnecting the deflector means and hopper for receiving deflected exhaust gases through the deflector means and dispensing the deflected gases to the hopper to heat the hopper and its contents.

13. The vehicle for patching a damaged area of a roadway surface as claimed by claim 9 further comprising:

a vacuum head on the turret means, adapted to receive roadway surface fragments loosened by the cutter head means; and collector means on the frame operatively connected to the vacuum head for supplying vacuum pressure through the vacuum head and for collecting and storing the roadway surface fragments received by the vacuum head.

14. The vehicle for patching a damaged area of a roadway surface as claimed by claim 13, wherein the vacuum head is mounted to the tool support carriage for vertical movement thereon independently of the cutter head.

15. The vehicle for patching a damaged area of a roadway surface as claimed by claim 13, wherein the collector means includes:

a collection hopper on the frame adapted to receive and store roadway surface fragments loosened by the cutter head;

a vacuum line extending between the collection hopper and vacuum head; and further comprising water collection means including:

a valve in the vacuum line;

a water collection tank; and a water suction line leading from the water collection tank to the valve; and wherein the valve is operable to divert suction through the water suction line and into the water collection tank.

16. A vehicle for patching a damaged area along a roadway surface, comprising:

an elongated rigid frame having a front and a rearward end;

front and rear pairs of wheels on the frame at the respective front and rear frame ends for movably supporting the frame along the roadway surface;

as an operator's control station on the frame adjacent an end thereof;

a tool support carriage on the frame adjacent the operator's control station and between the front and rear wheels, selectively movable on the frame from within the operator's control station in forward, backward and side-to-side directions under the frame and within the confines thereof;

vertically movable cutter head means on the carriage selectively operable from the operator's control station for breaking the roadway surface into loose fragments and for preparing a cavity in the roadway surface;

repair material delivery means on the frame selectively operable from the operator's control station for deliverying roadway repair material from a hopper fixed to the frame to a discharge mounted on the carriage for movement therewith;

vertically movable applicator means for receiving repair material from the delivery means and for filling a cavity formed in a roadway surface by the cutter head means;

vertically movable torch means for heating and drying surfaces of a cavity;

collector means including a vertically movable vacuum head for suctioning solid particulate debris and liquids such as water from within and around a cavity;

vertically movable ram tamper means for compacting the bottom surface of a cavity;

tack coat means for spraying a adhesive material into a cavity; and turret means on the carriage for movement therewith and mounting the cutter head means, vacuum head, applicator means, torch means, ram tamper means and tack coat means to the carriage for selective rotational movement thereon about an upright axis to an operating station under the frame in clear view from the operator's control station.

17. The vehicle for patching a damaged area along a roadway surface as claimed by claim 16 further comprising a vertically movable vibratory tamper means mounted to the turret for selective rotation therewith for compacting repair materials placed within the cavity through said applicator means.

18. The vehicle for patching a damaged area along a roadway surface as claimed by claim 17 further comprising a roller rotatably mounted to the vehicle frame clear of the tool support carriage for engaging and pressing against the roadway surface to press repair materials into the filled cavity to a level consistent with the remaining undamaged surface of the roadway.

19. The vehicle for patching a damaged area along a roadway surface as claimed by claim 16 wherein the repair delivery means is comprised of:

first and second trough conveyors, the first trough conveyor being connected to the fixed hopper and extending therefrom to a discharge end remote from the hopper, for receiving roadway repair material from the hopper and delivering it to the discharge end, and the second trough conveyor being elongated and connected to the first trough conveyor at the discharge end thereof for pivotal motion about an axis passing through the first trough conveyor discharge and for longitudinal sliding motion in relation to the first trough conveyor, the second trough conveyor having a discharge connected to the applicator means.

20. The vehicle for patching a damaged area along a roadway surface as claimed by claim 19 wherein the hopper and the trough conveyors are double walled, forming enclosed plenum chambers and further comprising heater means connected to said plenum chambers for circulating heated gases to heat and maintain the repair materials within the hopper and trough conveyors in a heated condition.

21. The vehicle for patching a damaged area along a roadway surface as claimed by claim 20 further comprising:

internal combustion drive means on the frame operatively connected to wheels on the frame for selectively powering the frame to move along;

wherein said internal combustion drive means includes an exhaust system for discharging exhaust gases through a discharge pipe;

deflector means attached to the exhaust system, selectively operable to deflect exhaust from the discharge pipe; and an auxiliary heat pipe interconnecting the deflector means and hopper for receiving deflected exhaust gases through the deflector means and dispensing the deflected gases to the hopper to heat the hopper and its contents.

22. The vehicle for patching a damaged area along a roadway surface as claimed by claim 16 further comprising vertically movable rotary brush means on the turret means, selectively operable to brush repair material into a cavity from a surrounding roadway surface.

23. The vehicle for patching a damaged area along a roadway surface as claimed by claims 22 wherein the brush includes a circular bristle brush driven to rotate about an inclined axis.

24. The vehicle for patching a damaged area along a roadway surface as claimed by claim 16 wherein the collector means is comprised of:

a collection hopper on the frame adapted to receive and store roadway surface fragments loosened by the cutter head;

a vacuum line extending between the collection hopper and vacuum head; and water collection means including:

a valve in the vacuum line;

a water collection tank; and a water suction line leading from the water collection tank to the valve;

wherein the valve is operable to divert suction through the water suction line and into the water collection tank.

25. The vehicle for patching a damaged area along a roadway surface as claimed by claim 16 wherein the applicator means is centered on the upright axis of the turret and wherein the vacuum means, cutter head, torch means, ram tamper means and tack coat means are angularly oriented about the axis and radially spaced in relation thereto from the applicator means.

* * * * *